US012486082B1

(12) United States Patent
Nyul

(10) Patent No.: US 12,486,082 B1
(45) Date of Patent: Dec. 2, 2025

(54) PACKAGING DEVICE

(71) Applicant: Plasel Plastic LTD., Lavon (IL)

(72) Inventor: Alon Nyul, Kfar Vradim (IL)

(73) Assignee: Plasel Plastic LTD, Lavon (IL)

( * ) Notice: Subject to any disclaimer, the term of this patent is extended or adjusted under 35 U.S.C. 154(b) by 0 days.

(21) Appl. No.: 19/285,907

(22) Filed: Jul. 30, 2025

(51) Int. Cl.

| | |
|---|---|
| ***B65D 85/28*** | (2006.01) |
| ***B65D 21/08*** | (2006.01) |
| ***B65D 41/34*** | (2006.01) |
| ***B65D 85/20*** | (2006.01) |

(52) U.S. Cl.
CPC ..... *B65D 41/3428* (2013.01); *B65D 21/086* (2013.01); *B65D 85/20* (2013.01)

(58) Field of Classification Search
CPC .. B65D 21/08; B65D 21/086; B65D 41/3428; B65D 85/20; B25H 3/003
USPC ..... 206/349, 372, 379, 807; 220/4.31, 8
See application file for complete search history.

(56) References Cited

U.S. PATENT DOCUMENTS

| | | | | |
|---|---|---|---|---|
| 4,509,656 | A * | 4/1985 | Rosler | B65D 21/086 220/8 |
| 4,596,340 | A * | 6/1986 | Luther | B65D 21/086 220/8 |
| 5,605,242 | A | 2/1997 | Hwang | |
| 5,829,591 | A | 11/1998 | Lyons | |
| 7,740,136 | B2 * | 6/2010 | Roesler | B25H 3/003 206/480 |
| 8,789,694 | B2 * | 7/2014 | Roesler | B65D 21/086 206/349 |
| 10,723,512 | B2 * | 7/2020 | Hadar | F16G 11/12 |
| 10,906,695 | B2 * | 2/2021 | Hadar | B65D 21/086 |
| 11,643,250 | B2 * | 5/2023 | Kersley | B65D 55/02 206/1.5 |
| 2006/0283769 | A1 * | 12/2006 | Roesler | B65D 85/20 206/349 |
| 2008/0185305 | A1 * | 8/2008 | Roesler | B25H 3/003 206/349 |
| 2015/0076149 | A1 | 3/2015 | Roesler | |
| 2019/0152649 | A1 | 5/2019 | Hadar | |
| 2019/0233165 | A1 | 8/2019 | Hadar | |
| 2021/0147114 | A1 | 5/2021 | Nyul | |
| 2025/0002215 | A1 | 1/2025 | Eftink et al. | |

FOREIGN PATENT DOCUMENTS

| | | | |
|---|---|---|---|
| DE | 10107212 | A1 | 8/2002 |
| JP | H068929 | A | 1/1994 |
| JP | H11321865 | A | 11/1999 |
| KR | 101868876 | B1 | 6/2018 |
| KR | 20180060001 | A | 6/2018 |

* cited by examiner

*Primary Examiner* — Luan K Bui
(74) *Attorney, Agent, or Firm* — Myers Wolin, LLC

(57) ABSTRACT

A packaging device for coaxially aligning and retaining an elongated machining tool, comprising a plug and a cap configured to fit together, defining an inner space for accommodating the tool. The plug includes a cylindrical wall member with threading protrusions, an exterior wall segment with a noncircular contour, and a rotatable cork member with counterpart threading protrusions. In some embodiments, the device may feature tapering end-walls. Additionally, or alternatively, the rotatable cork member may comprise a tamper-evident band. The device may feature a rotation-preventive wall segment for non-rotatable engagement with the tamper-evident band.

20 Claims, 3 Drawing Sheets

PACKAGING DEVICE

TECHNICAL FIELD

The present disclosure relates to packaging devices in general, and more particularly to packaging devices for storing and transporting precision cutting tools.

BACKGROUND

Packaging devices for storing and transporting precision cutting tools have been utilized in various industries for many years. These devices typically aim to protect the delicate cutting edges of tools such as drill bits, end mills, and other machining implements during storage and transit. The design of such packaging often incorporates features to securely hold the tool in place, prevent damage from impacts or vibrations, and allow for easy insertion and removal of the tool.

SUMMARY

One exemplary embodiment of the disclosed subject matter is a packaging device for coaxially aligning and securely retaining an elongated machining tool. The packaging device comprises a plug, wherein the plug and a cap are configured to fit together. The plug and the cap mutually define an inner variable space for accommodating the elongated machining tool, the variable space has is tapering coaxially in opposite directions toward respective opposite ends of the packaging device between a first tapering end-wall constituting a member of the cap, and a second tapering end-wall constituting a member of the plug. The plug comprises a plug portion adapted to engage with a respective cap portion, and further comprises a cylindrical wall member extending away from the plug portion and opened on a first end towards the first tapering end-wall and on a second end, opposite to the first end, towards the second tapering end-wall; an exterior wall segment having a circumferential noncircular contour extending between the plug portion and the cylindrical wall member and constituting a rotation-preventive wall segment; threading protrusions formed on an outwardly facing surface of the cylindrical wall member; a rotatable cork member constituting a separable member of the plug and comprising the second tapering end-wall, the rotatable cork member further comprises counterpart threading protrusions formed on an inner wall-surface of the rotatable cork member and configured to engage with the threading protrusions on the outwardly facing surface of the cylindrical wall member.

Optionally, the plug includes a tamper-evident band configured to overlappingly engage with a predetermined surface area of the rotation-preventive wall segment, wherein the tamper-evident band is configured to break-apart from the rotatable cork member upon application of a predetermined angular offset from an initial position between a body of the rotatable cork member and the cylindrical wall member, with the tamper-evident band non-rotatably mounted on the rotation-preventive wall segment.

Optionally, the plug and the cap are configured to telescopically fit together, wherein the plug comprises a telescopic plug portion adapted to telescopically engage with the cap portion, and wherein the inner variable space is telescopically variable with a telescopically adjustable length between the cap and the plug.

Optionally, the rotation-preventive wall segment is polygonal in cross section transversely to a central longitudinal axis of the packaging device.

Optionally, the rotatable cork member is configured to take the initial position under exertion of a predetermined torque-free manual force for initially shutting the plug with the rotatable cork member, wherein in the initial position: (a) the counterpart threading protrusions on the rotatable cork member are engaged with the threading protrusions on the cylindrical wall member, and (b) the tamper-evident band are overlappingly engaged with the rotation-preventive wall segment.

Optionally, the counterpart threading protrusions extend at least partially on an inner wall segment of the rotatable cork member, wherein a clearance gap is formed between the inner wall segment and an exterior wall segment of the rotatable cork member next to the clearance gap, wherein the inner wall segment and the counterpart threading protrusions on it are flexibly compressible into the clearance gap under influence of the torque-free manual force.

Optionally, the exterior wall segment of the rotatable cork member next to the clearance gap and the inner wall segment on which the counterpart threading protrusions extend, mutually define square-circle complement region utilized for the clearance gap.

Optionally, a mechanism configuration included in the plug and allowing for the exertion of torque-free manual force for initially or repeatedly shutting the plug with its rotatable cork member comprises oblique surfaces extending each along a respective threading protrusion formed on the outwardly facing surface of the cylindrical wall member, the oblique surfaces being oriented to reduce frictional resistance resulting from dynamic-friction forces between crossing threading protrusions upon motion of counterpart threading protrusions of the rotatable cork member in a direction transversely to lengthwise orientation of respective threading protrusions formed on the cylindrical wall member under the influence of the torque-free manual force.

Optionally, a mechanism configuration included in the plug and allowing for the exertion of torque-free manual force for initially or repeatedly shutting the plug with its rotatable cork member comprises oblique surfaces extending each along a respective counterpart quarter-turn threading protrusion formed on the inner wall-surface of the rotatable cork, the oblique surfaces being oriented to reduce frictional resistance resulting from dynamic-friction forces between crossing threading protrusions upon motion of the counterpart threading protrusions of the rotatable cork member in a direction transversely to lengthwise orientation of respective threading protrusions formed on the cylindrical wall member under the influence of the torque-free manual force.

Optionally, a mechanism configuration included in the plug and allowing for the exertion of torque-free manual force for initially or repeatedly shutting the plug with its rotatable cork member comprises an inwardly oriented guide-protrusion configured to engage with and to advance through a respective linear slanting-indentation under influence of the torque-free manual force, wherein the slanting-indentation constitutes a linear channel having a longitudinal axis coplanar with a central longitudinal axis of the cylindrical wall member and having a gradually varying depth, originating with a maximum predetermined depth on an edge of the cylindrical wall member facing the second tapering end-wall the channel extends along the outer surface of the cylindrical wall member ending with a minimum depth point at a mid-portion of the outer surface of the hollow cylinder.

Optionally, the minimum depth point at the end of the channel features a seamless merger between the channel and the outer surface of the cylindrical wall member.

Optionally, the inwardly oriented guide-protrusion inwardly protrudes from a circumferential wall surface of the rotatable cork member.

Optionally, the guide-protrusion and the slanting indentation are dimensioned and positioned to maintain the guide-protrusion outside the indentations when the rotatable cork is in a partial-turn-enabled position on the plug, and in frictional engagement with outwardly facing surface of the cylindrical wall member.

Optionally, the rotatable cork member and the cylindrical wall member are mutually interlocked in the initial position by mutual protrusion and indentation arrangement requiring a predetermined torque to disengage.

Optionally, the tamper-evident band is connected by breakable perforation ribs to an edge of the rotatable cork member.

Another exemplary embodiment of the disclosed subject matter is a packaging device for coaxially aligning and retaining a machining tool. The packaging device comprises a plug comprising a polygonal plug part having a cylindrical wall member extending therefrom, the cylindrical wall member having an outwardly facing surface, wherein the cylindrical wall member comprises threading protrusions formed on the outwardly facing surface. The plug is configured in size and shape to telescopically engage with a cap to define an inner variable space for accommodating the machining tool. The packaging device also comprises a rotatable cork member separably engageable with the cylindrical wall member of the plug, wherein the rotatable cork member comprises counterpart threading protrusions formed on an inner wall surface, the counterpart threading protrusions configured to engage with the threading protrusions on the outwardly facing surface of the cylindrical wall member, wherein the rotatable cork member comprises a tamper-evident band configured to overlappingly engage with a predetermined surface area of the polygonal plug part, wherein the tamper-evident band is configured to break apart from the rotatable cork member upon application of a predetermined angular offset between the rotatable cork member and the cylindrical wall member.

Optionally, the rotatable cork member comprises inwardly oriented guide protrusions configured to engage with and advance through respective linear slanting indentations on the outwardly facing surface of the cylindrical wall member.

Optionally, each of the linear slanting indentations comprises a channel having a gradually varying depth, originating with a maximum predetermined depth on an edge of the cylindrical wall member facing a tapering end wall of the rotatable cork member and ending with a minimum depth point at a mid-portion of the outwardly facing surface of the cylindrical wall member.

Optionally, the threading protrusions on the cylindrical wall member and the counterpart threading protrusions on the rotatable cork member are configured with a predetermined degree of inclination to facilitate partial axial separation of the rotatable cork member from the cylindrical wall member when in an open state.

Optionally, the counterpart threading protrusions extend at least partially on an inner wall segment of the rotatable cork member, the inner wall segment being configured with a predetermined degree of flexibility to allow compression, wherein the predetermined degree of flexibility of the inner wall segment allows the counterpart threading protrusions to engage with the threading protrusions on the cylindrical wall member under influence of a torque-free manual force.

Optionally, the threading protrusions on the cylindrical wall member are formed with oblique surfaces oriented to reduce frictional resistance upon motion of the counterpart threading protrusions in a direction transverse to a lengthwise orientation of the threading protrusions.

Optionally, the packaging device further comprises the cap, wherein the cap comprises at least one locking protrusion configured to engage with one of multiple vertically spaced slits formed on an external surface of the plug to allow the cap to lock at variable heights over the plug.

THE BRIEF DESCRIPTION OF THE SEVERAL VIEWS OF THE DRAWINGS

The present disclosed subject matter will be understood and appreciated more fully from the following detailed description taken in conjunction with the drawings in which corresponding or like numerals or characters indicate corresponding or like components. Unless indicated otherwise, the drawings provide exemplary embodiments or aspects of the disclosure and do not limit the scope of the disclosure. In the drawings.

DETAILED DESCRIPTION

Storage containers may be designed to coaxially align and securely retain dense elongate cylindrical machining tools, such as those used in the milling industry. Container may be, for example, similar to the container disclosed in U.S. Patent Application Publication No. US 2021/0147114 A1, published on May 20, 2021, entitled "STORAGE CONTAINER AND A METHOD FOR ITS MANUFACTURE", which is hereby incorporated by reference in its entirety for all purposes without giving rise to disavowment.

In some exemplary embodiments, constructed from plastic with a transparent cap member and an opaque base member overlapping in their telescopically engaged regions, these containers may feature a telescopically adjustable structure that accommodates a wide range of tool sizes. Tapering tool retention portions at the ends of the base member and the cap, respectively, may ensure precise alignment and retention of the tool, despite variations in tool length or diameter.

The side walls of the base member, having a square cross-section, are provided with a series of uniformly spaced transverse slots positioned in the mid-portion of each wall, spanning approximately half the wall's width. The cap member includes an inwardly projecting elongate protrusion on its inner surface, configured to engage a selected slot, thereby securing the cap member to the base member in any selected telescopic position.

In some cases, opening the storage container by removing the cap may require considerable force, and it may be desired to enable easier opening that would enhance convenience. The quality of the closure must be preserved, ensuring the cap member's telescopic engagement with the base member remains uncompromised.

Additionally, or alternatively, it may be desired to provide an improved version without significantly altering the design of the version with a single opened side. It may also be advantageous to provide a solution that uses a same cap as the version with the single opened side.

It may be desired to provide a design that maintains substantially identical external dimensions and compatibility with packaging equipment, requiring no modifications to the manufacturer's tool insertion and sealing processes. Simultaneously, the improved storage container should offer enhanced usability and convenience.

Figure 1:
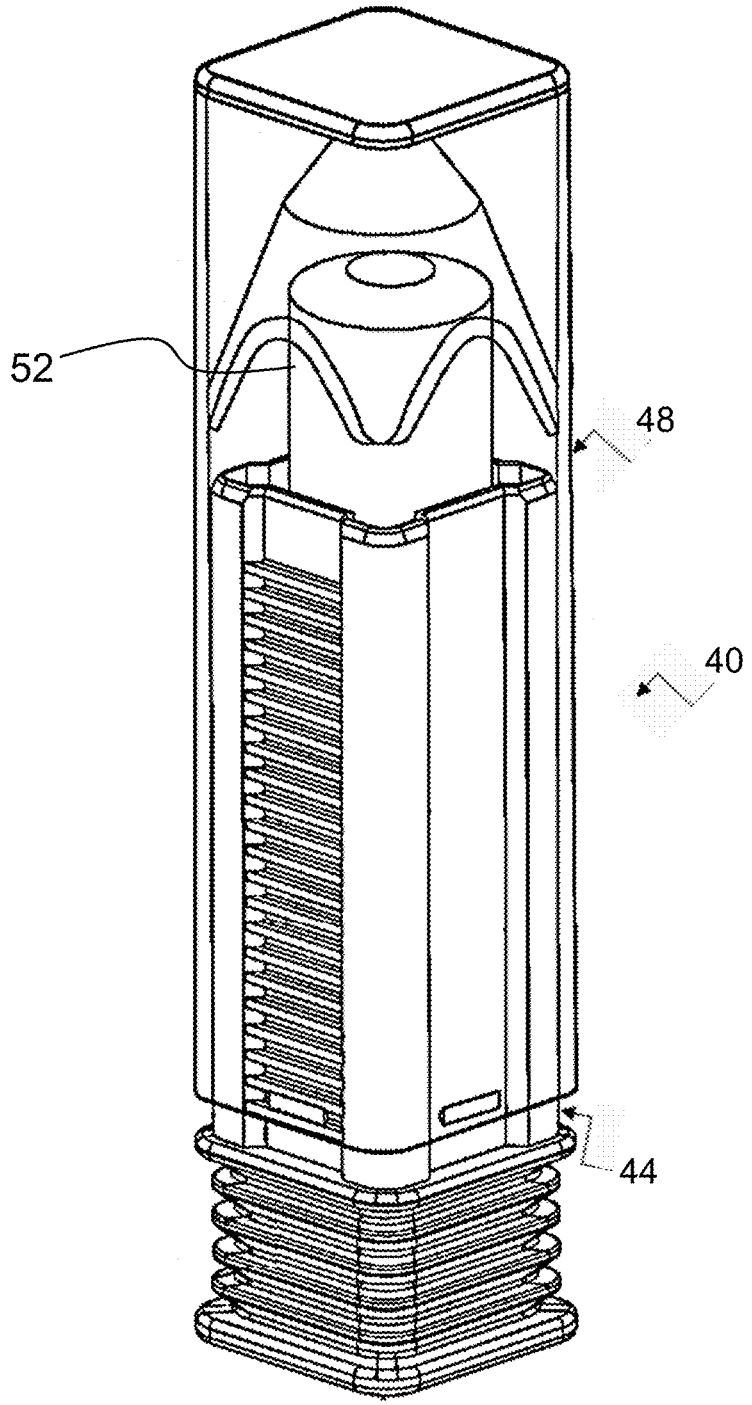
FIG. 1 illustrates in isometric view a storage container with an upper portion of cylindrical article shown inside the storage container through a transparent cap member, in accordance with some exemplary embodiments of the disclosed subject matter.
Figure 2:
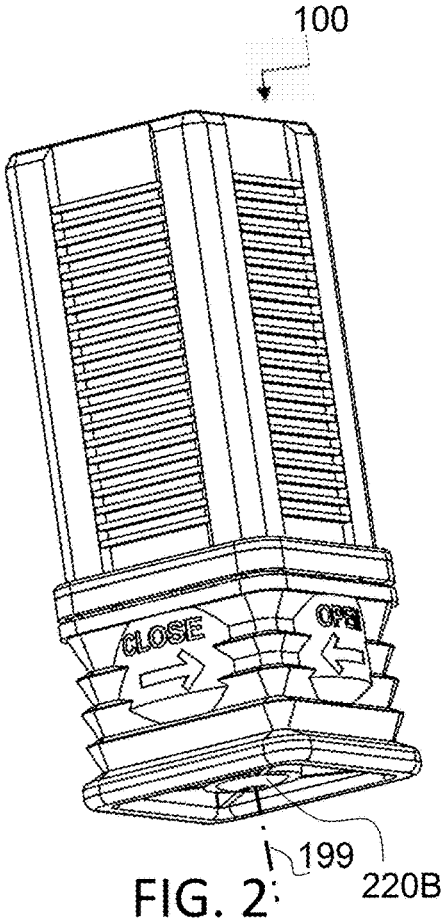
FIG. 2 illustrates a plug of a storage device, in accordance with some exemplary embodiments of the disclosed subject matter.

FIG. 1 shows an example of a container 40. Container 40 is a version having a single opened side (top side). Cover member 48 is used to close container 40 by covering base member 44. The position of the cover member 48 with respect to base member 44 may be maintained by mutual interlocking means and can be opened using force. Additionally, or alternatively, the position of the cover member 48 with respect to base member 44 may be maintained due to friction requiring a force above a threshold to release the cover member 48. Container 40 is used to retain an elongate cylindrical tool 52.

A first broad aspect of the presently disclosed subject matter is a packaging device for coaxially aligning and securely retain machining tools, which provide its users with opening and closing procedures.

Figure 3:
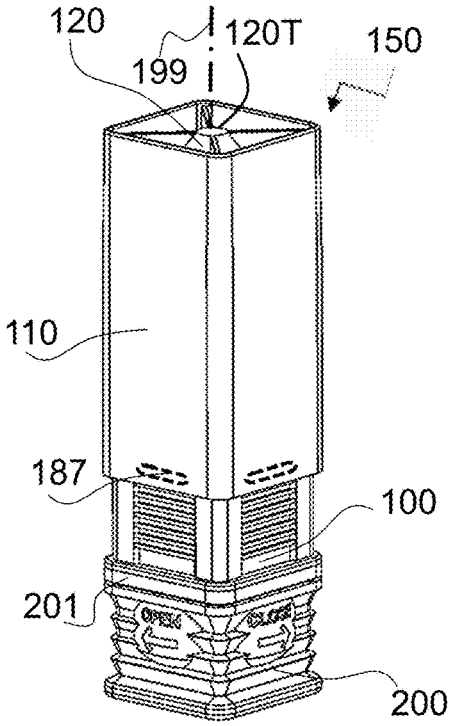
FIG. 3 illustrates an engaged cap and plug constituting a storage device, in accordance with some exemplary embodiments of the disclosed subject matter.

Referring now to FIG. 3, an embodiment of a packaging device 150 according to the presently disclosed subject matter is disclosed. Packaging device 150 comprises a cap 110 and a plug 100. Cap 110 and plug 100 may fit telescopically together to mutually define an inner telescopically variable space for accommodating a tool to be packaged.

Each inner face of the body of cap 110 may feature a respective locking protrusion 187 at the bottom. Locking protrusion 187 may be adapted to engage one of multiple vertically spaced slits 188 formed on the external surface of plug 100. Locking protrusion 187 may allow the cap 110 to lock at variable heights over plug 100.

In the illustrated embodiment, the slits 188 are identical by their width length and height and are spaced evenly. Consequently, the current height of lock is a function of the count of slits from the ledge 103 up to the location of the slit currently engaged by protrusion 187.

It is noted that slits 188 may be spaced unevenly, and each may have different widths, lengths, or heights. It is also noted that slits 188 and locking protrusions 187 may be present only on a portion of the faces of cap 110 or of plug 100.

The telescopically variable space has a telescopically adjustable length between the cap 110 and the plug 100. The telescopically variable space may possess coaxial tapering in opposite directions toward respective opposite ends 120T (constituting a top end) and 220B (constituting a bottom end) of the packaging device 150, between a first tapering end-wall 120 constituting a member of the cap 110, and a second tapering end-wall 220 constituting a member of the plug 100.

The plug 100 comprises a telescoping plug part 170. The telescoping plug part 170 may be adapted to telescopically engage with a respective cap portion. The telescoping plug part 170 may comprise a cylindrical wall member 122 extending away from the telescoping plug part 170.

In some exemplary embodiments, cylindrical wall member 122 may be hollow. Additionally, or alternatively, an opening may be provided between the first tapering end-wall 120 and the second tapering end wall 220. In some exemplary embodiments a cylindrical wall member 122 may be opened on a first end 122U towards the first tapering end-wall 120 and on a second end 122D, opposite to the first end, towards the second tapering end-wall 220.

In some exemplary embodiments, the plug 100 comprises an exterior wall segment 101, having a circumferential noncircular contour (e.g., polygonal as depicted). The wall segment 101 extends between the telescopic section 170 of the plug 100, and the cylindrical wall member 122, and constitutes (thanks to its polygonal noncircular contour) a rotation-preventive arrangement for the tamper-evident band 201, which is polygonal as well, in match and with overlapping relationship with the wall segment 101.

In some exemplary embodiments, the plug 100 comprises threading protrusions 100T (e.g., illustrated as exemplary designed for quarter-turn, but not limited to such embodiment) formed on an outwardly facing surface 124 of the cylindrical wall member 122.

In various embodiments according to the presently disclosed subject matter, the surface 124 on which the threading protrusions 100T extend may be shallower with respect to remaining outwardly facing surface portions of the cylindrical wall member 122. In such embodiments, the threading protrusions 100T may end flush with said remaining outwardly facing surface portions.

The rotatable cork member 200 constitutes a separable member of the plug 100 and comprises the second tapering end-wall 220.

In some exemplary embodiments, the rotatable cork member 200 comprises a counterpart threading protrusions 200T formed on an inner wall-surface (e.g., on the inwardly facing surface of wall segment 230) of the rotatable cork member 200. The counterpart threading protrusions 200T are configured to engage with the threading protrusions 100T on the outwardly facing surface 124 of the cylindrical wall member 122.

In some exemplary embodiments, the tamper-evident band 201 is a breakable constituent of the rotatable cork member 200, and is configured to overlappingly engage with a predetermined surface area of the rotation-preventive wall segment 101. A wall ledge 103 may be provided between the telescoping part 170 of the plug 100 and the rotation-preventive wall segment 101, for protecting the tamper-evident band 201 from above, and/or for once broken apart preventing it from falling toward the telescoping part 170 and from interfering with the telescopic functioning.

In some exemplary embodiments, the tamper-evident band 201 is configured to break-apart from the rotatable cork member 200 upon application of a predetermined angular offset between the rotatable cork member body 200, and the cylindrical wall member 122. The angular offset makes the break-apart to occur, because the tamper-evident band is non-rotatably mounted on the rotation-preventive wall segment 101, thus cannot follow the angular displacement of the cork member.

The tamper-evident band 201 is joined on top of the cork body 200 through a breakable connective means or perforation arrangement, e.g., ribs 202. Upon a predetermined angular displacement of the body 200 of the cork member with respect to the tamper-evident band 201, the ribs 201 break or tear, freeing the tamper-evident band 201 from the cork body.

The user may then separate the rotatable cork member 200 from the plug 100 and discard the separated band, leaving the rotation-preventive wall segment 101 exposed as a reminder or indicator of the non-mint status of the packaging content.

A second broad aspect of the presently disclosed subject matter is a packaging device 150 which is compatible with the packing method, automation, robotics and machinery used for containers version with a single opened side.

In a disassembled state of the plug part 100A and the cork member 200, the plug part 100A is opened at the end 122D of the cylindrical wall member 122. The rotatable cork member 200 is configured to take its initial position as a constituent of plug 100. In the initial position, the counterpart threading protrusions 200T are engaged with the threading protrusions 100T on the cylindrical wall member 122. Likewise, the tamper-evident band 201 is overlappingly engaged with the rotation-preventive wall segment 101. Starting from the disassembled state illustrated by FIG. 4, the plug part 100A and the rotatable cork member 200 can be brought into the initial position by aligning them along the central common axis 199 (with no angular offset between them) then compressing them together under a predetermined amount of torque-free manual force. This will shut the plug 100 for the first time (may be performed at the packaging production factory), making it compatible with a plug 100 of container version with a single opened side. This configuration allows for relative linear movement along axis 199 between the plug 100 and the rotatable cork member 200.

In some exemplary embodiments, the clearance gap 211 allows for the compression of the inner wall segment 230 and its associated counterpart threading protrusions 200T. This compression mechanism enables the initial assembly of the plug 100 and rotatable cork member 200 without the need for rotational force. The predetermined degree of flexibility of the inner wall segment 230 is engineered to provide sufficient give for compression while maintaining the structural integrity necessary for secure engagement with the threading protrusions 100T on the cylindrical wall member 122.

In some exemplary embodiments, the relative linear movement along axis 199 between the plug 100 and the rotatable cork member 200 is facilitated by this flexible compression mechanism. As manual force is applied along the axis, the counterpart threading protrusions 200T can temporarily deform, (e.g., into the clearance gap 211), allowing them to slide past the threading protrusions 100T on the cylindrical wall member 122. Once the force is released, the inner wall segment 230 returns to its original shape, with the counterpart threading protrusions 200T engaging securely with the threading protrusions 100T.

In some exemplary embodiments, this design feature allows for easy initial assembly of the packaging device at the manufacturing facility. Additionally, or alternatively, this design provides a tamper-evident feature when combined with the breakable band, as the device can be reassembled but will show evidence of prior opening.

In some exemplary embodiments, the design maintains compatibility with packaging equipment and processes used for single-opening versions, as the external dimensions and assembly method remain similar to single-opening versions.

Figure 4:
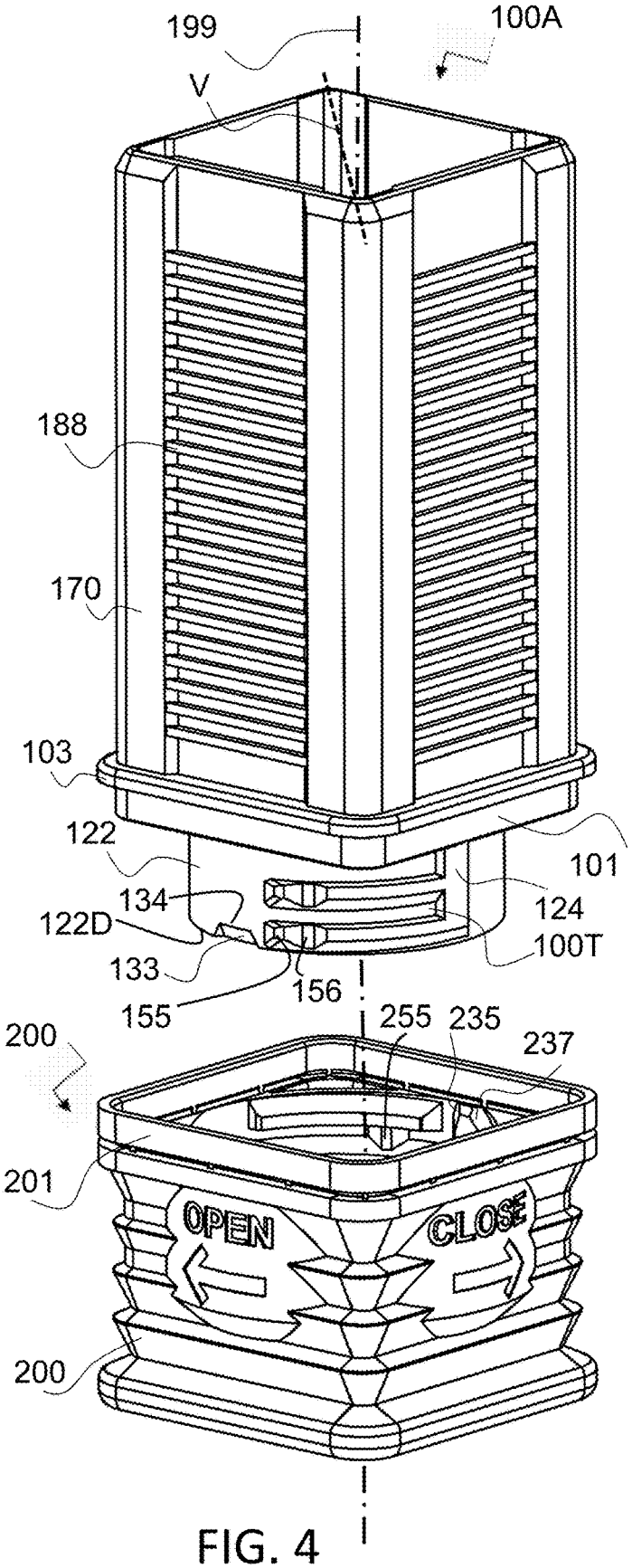
FIG. 4 illustrates an exploded view of the plug of FIG. 2 showing the rotatable cork member of the plug and the telescoping part of the plug in mutual alignment along a central longitudinal axis, ready for assembling, in accordance with some exemplary embodiments of the disclosed subject matter.
Figure 5A:
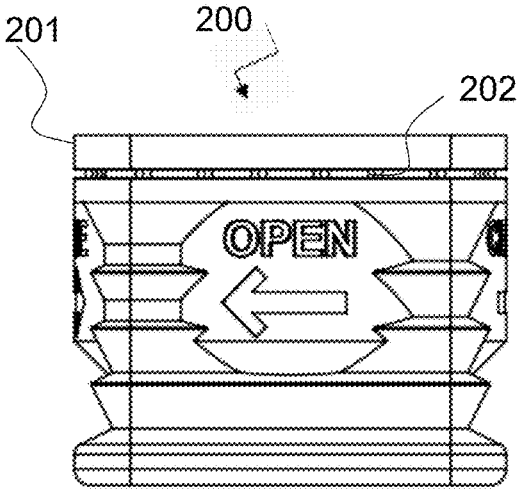
FIG. 5A illustrates in a front view a rotatable cork member embodiment of the plug, in accordance with some exemplary embodiments of the disclosed subject matter.
Figure 5B:
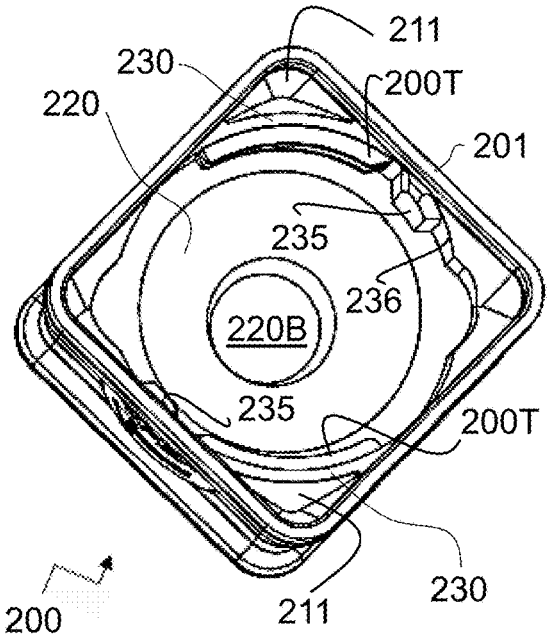
FIG. 5B illustrates an isometric top view of the rotatable cork member of FIG. 5A, in accordance with some exemplary embodiments of the disclosed subject matter.
Figure 5C:
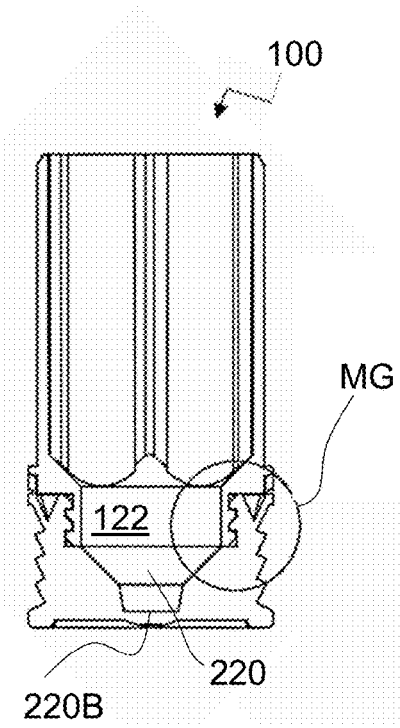
FIG. 5C illustrates a vertical cross section view of a plug, in accordance with some exemplary embodiments of the disclosed subject matter.
Figure 5D:
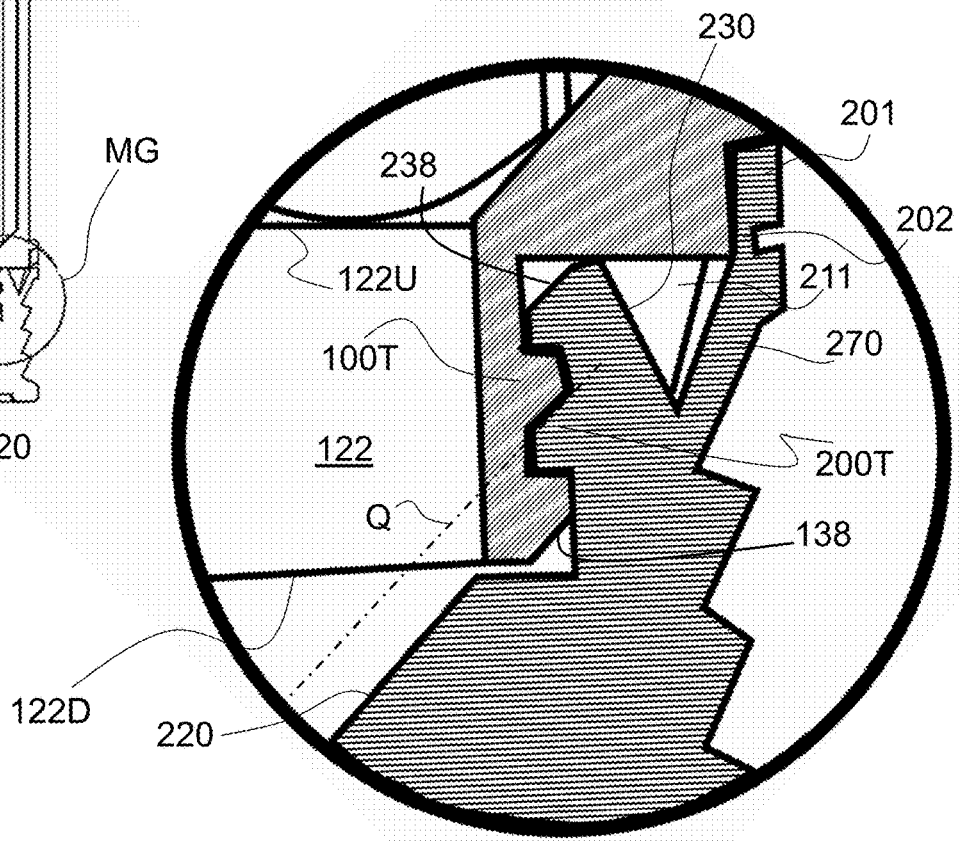
FIG. 5D illustrates enlargement of a portion denoted MG in the vertical cross section shown by FIG. 5C, in accordance with some exemplary embodiments of the disclosed subject matter.

FIG. 5C illustrates a vertical cross section view of a plug 100 according to the presently described subject matter, taken vertically through dashed line V (see FIG. 4) and assuming the rotatable cork member 200 is in the initial position on plug part 100A. The circled region denoted MG of the cross section is shown with enlargement in FIG. 5D.

In various embodiments according to the presently disclosed subject matter, the mechanism allowing for the exertion of said torque-free manual force for initially or repeatedly shutting the plug 100 with its rotatable cork member 200, may comprise a configuration in which the counterpart threading protrusions 200T extend at least partially on an inner wall segment 230 of the rotatable cork member 200, wherein a clearance gap 211 is formed between the inner wall segment 230 and an exterior wall segment 270 (see FIG. 5D) of the rotatable cork member 200 next to the clearance gap 211. The inner wall segment 230 and the counterpart threading protrusions 200T on it, may be to be configured with a predetermined degree of flexibility, allowing them to be flexibly compressible into the clearance gap 211 under influence of the torque-free manual force.

As may be appreciated, the depicted embodiment takes advantage of polygon-circle complement regions for implementing the clearance gap 211.

In various embodiments according to the presently disclosed subject matter, the mechanism allowing for the exertion of said torque-free manual force for initially or repeatedly shutting the plug 100 with its rotatable cork member 200, may comprise a configuration in which the threading protrusions 100T are formed with oblique surfaces 138. The oblique surfaces may be oriented to reduce frictional resistance resulting from dynamic-friction forces between threading protrusions 100T and their counterpart 200T upon motion of counterpart threading protrusions 200T of the rotatable cork member 200 in a direction transversely to lengthwise orientation of respective threading protrusions 100T formed on the cylindrical wall member 122 under the influence of the torque-free manual force.

In some exemplary embodiments, the counterpart threading protrusions 200T may be formed with oblique surfaces 238 extending each along a respective counterpart threading protrusion 200T formed on the inner wall-surface of wall segment 230.

In various embodiments according to the presently disclosed subject matter, an imaginary axis Q (see FIG. 5D) tangential to an oblique surface 238 or 138 and intersecting the longitudinal axis 199 forms a predetermined angle of between 40 and 60 degrees with the longitudinal axis 199.

In various embodiments according to the presently disclosed subject matter, the mechanism allowing for the exertion of said torque-free manual force for initially or repeatedly shutting the plug 100 with its rotatable cork member 200, may comprise a configuration in which inwardly oriented guide-protrusions 235 are configured to engage with and to advance through respective linear slanting-indentations 133 under influence of the torque-free manual force.

In some exemplary embodiments, there may be a single linear slanting indention 133. Additionally, or alternatively, there may be any number of multiple linear slanting indention 133 angularly spaced on the outer surface of the cylindrical wall member 122. In some exemplary embodiments the number of guide-protrusions 235 and their angular spacing may be identical to the number and angular spacing of linear indentations 133.

Each of the slanting-indentations 133 constitutes a linear channel having a longitudinal axis coplanar with a central longitudinal axis 199 of the cylindrical wall member 122 and having a gradually varying depth, originating with a maximum predetermined depth on an edge 122D of the cylindrical wall member 122 facing the second tapering end-wall 220, the channel extends along the outer surface of the cylindrical wall member 122, ending with a minimum depth point at a mid-portion 134 of the outer surface of the cylindrical wall member 122.

In some exemplary embodiments, the linear channel formed by slanting-indentation 133 may feature a seamless merger with the outer surface 122 of the cylindrical wall member 122.

In some exemplary embodiments, the guide-protrusions 235 protrude from a circumferential wall surface 236 of the rotatable cork member 200.

In some exemplary embodiments, each of the guide-protrusions 235 may comprise a protrusion-segment 237 inclined to the circumferential wall surface 236, whereby facilitating protrusion-channel engagement upon initiation of the mutual cork and plug assembling process.

In some exemplary embodiments, the slanting-indentations 133 are dimensioned and positioned to maintain the guide-protrusions 235 outside the indentations when the rotatable cork 200 is in a turn-enabled position on the plug body 100A, and to maintain frictional engagement with outwardly facing surface of the cylindrical wall member 122, whereby avoiding free fall of the rotatable cork member 200 off the plug body 100A when the counterpart threading protrusions 200T become withdrawn from the threading protrusions 100T following a partial-turn (e.g., quarter turn) of the rotatable cork member 200.

In some exemplary embodiments, the rotatable cork member 200 and the cylindrical wall member 122 are mutually interlocked in the initial position by mutual protrusion and indentation arrangement (e.g., protrusion 255 interfering with the counterpart quarter-turn threading 200T and cooperating with an indentation 155 delimited by a neighboring protrusion 156, interfering with the threading protrusions 100T) requiring a predetermined torque to disengage.

In the illustrated embodiment, the rotatable cork member 200 and the plug part 100A each possess 180-degree rotational symmetry about the longitudinal axis 199, thus the indentation 155 shown in the drawing of FIG. 4, interlocks with a protrusion 255 located 180-degree away from the protrusion 255 shown (thus hidden in the drawing by walls 200). Vise versa, the protrusion 255 shown in the drawing interlocks with an indentation 155 hidden in the drawing and located 180-degree away from the indentation 155 shown in the drawing.

In some exemplary embodiments, the rotatable cork member 200 and the plug part 100A require a counterclockwise partial-turn (e.g., quarter-turn) of the rotatable cork member 200 with respect to the plug part 100A about the central longitudinal axis 199 for freeing the rotatable cork member 200 from the plug part 100A.

In some exemplary embodiments, lacking the tamper-evident band 201 once removed, returning the plug part 100A back to the initial position can be performed as a matter of choice by either inserting it twisted (e.g., 90-degree for a quarter-turn cork configuration) counterclockwise from the initial position then rotating it a partial-turn (e.g., quarter-turn) clockwise with respect to the plug part 100A into the initial position, or inserting it directly to engage with a snap into the initial position under the influence of a torque-free manual force.

In some exemplary embodiments, the threading protrusions 100T and their counterparts 200T may be provided with a degree of helicity or inclination towards their mutual withdrawal state which constituted cork's open state (in which the rotatable cork 200 may be pulled away from the plug part 100). Consequently, in its open state the rotatable cork 200 may become partially pulled away from the plug part 100A in the axial direction 199, compared with its axial position about the plug part in the initial position. In some exemplary embodiments, the deviation in the orientation of the threading protrusions 100T and their counterparts 200T due to the provision of inclination with respect to a non-inclined (horizontal) orientation, is between 0.5 and 5 degrees.

In some exemplary embodiments, the implementation of the illustrated embodiments may be performed taking chirality inversion, whereby inversing between clockwise and counterclockwise functionality, with respective reversal between the opening and closing directions of the rotatable cork member 200.

The descriptive term "noncircular", as used herein, refers to an object's closed shape or contour in a two-dimensional plane that deviates from a circular form by including at least one irregularity, such as a protrusion, indentation, or other geometric deviation, sufficient to prevent rotational motion of the object having that shape, when the object is closely overlapped with or overlaps another object having complementary noncircular shape. The term encompasses any shape, including but not limited to polygons, irregular forms, or modified circular shapes, that exhibits a lack of complete rotational symmetry due to the presence of the irregularity. For example, a shape derived from a circle but modified with a protrusion or indentation that restricts rotation when engaged with a complementary shape is considered a noncircular shape.

The descriptive term "polygonal", as used herein, refers to a closed shape or contour having a predetermined number of sides, such as three sides, four side, five sides, six sides, seven sides, eight sides, nine sides, ten sides, 11 sides, or the like, wherein each side is defined by a segment that is at least partially straight or substantially aligns with a straight line, such that the overall shape at least partially overlaps with or approximates a polygon when viewed in a two-dimensional plane. The term includes shapes with straight sides, as well as variations thereof, such as shapes with rounded corners, curved segments, or other irregularities, provided the shape retains a general configuration consistent with a polygon having the specified number of sides. For example, a square with rounded corners or a pentagon with one or more curved segments is considered a polygonal shape if it substantially corresponds to a four-sided or five-sided polygon, respectively.

The corresponding structures, materials, acts, and equivalents of all means or step plus function elements in the claims below are intended to include any structure, material, or act for performing the function in combination with other claimed elements as specifically claimed. The description of the present disclosed subject matter has been presented for purposes of illustration and description, but is not intended to be exhaustive or limited to the disclosed subject matter in the form disclosed. Many modifications and variations will be apparent to those of ordinary skill in the art without departing from the scope and spirit of the disclosed subject matter. The embodiment was chosen and described in order to best explain the principles of the disclosed subject matter and the practical application, and to enable others of ordinary skill in the art to understand the disclosed subject matter for various embodiments with various modifications as are suited to the particular use contemplated.

What is claimed is:

1. A packaging device for coaxially aligning and securely retaining an elongated machining tool, the packaging device comprising a plug, wherein the plug and a cap are configured to telescopically fit together, wherein the plug and the cap mutually define an inner telescopically variable space for accommodating the elongated machining tool, the telescopically variable space has a telescopically adjustable length between the cap and the plug, and is tapering coaxially in opposite directions toward respective opposite ends of the packaging device between a first tapering end-wall constituting a member of the cap, and a second tapering end-wall constituting a member of the plug;

wherein the plug comprises a telescopic plug portion adapted to telescopically engage with a respective cap portion, and further comprises (i) a cylindrical wall member extending away from the telescopic plug portion and opened on a first end towards the first tapering end-wall and on a second end, opposite to the first end, towards the second tapering end-wall;

(ii) an exterior wall segment having a circumferential noncircular contour extending between the telescopic plug portion and the cylindrical wall member and constituting a rotation-preventive wall segment configured to non-rotatably receive a tamper-evident band;

(iii) a threading protrusions formed on an outwardly facing surface of the cylindrical wall member;

(iv) a rotatable cork member constituting a separable member of the plug and comprising the second tapering end-wall, the rotatable cork member further comprises a counterpart threading protrusions formed on an inner wall-surface of the rotatable cork member and configured to engage with the threading protrusions on the outwardly facing surface of the cylindrical wall member, and a break-away tamper-evident band configured to overlappingly engage with a predetermined surface area of the rotation-preventive wall segment;

wherein the tamper-evident band is further being configured to break-apart from the rotatable cork member upon application of a predetermined angular offset from an initial position between a body of the rotatable cork member and the cylindrical wall member, with the tamper-evident band non-rotatably mounted on the rotation-preventive wall segment.

2. The packaging device according to claim 1 wherein the rotation-preventive wall segment is polygonal in cross section transversely to a central longitudinal axis of the packaging device.

3. The packaging device according to claim 1 wherein the rotatable cork member is configured to take the initial position under exertion of a predetermined torque-free manual force for initially shutting the plug with the rotatable cork member, wherein in the initial position: (a) the counterpart threading protrusions on the rotatable cork member are engaged with the threading protrusions on the cylindrical wall member, and (b) the tamper-evident band are overlappingly engaged with the rotation-preventive wall segment.

4. The packaging device according to claim 3, wherein the counterpart threading protrusions extend at least partially on an inner wall segment of the rotatable cork member, wherein a clearance gap is formed between the inner wall segment and an exterior wall segment of the rotatable cork member next to the clearance gap, wherein the inner wall segment and the counterpart threading protrusions on it are flexibly compressible into the clearance gap under influence of the torque-free manual force.

5. The packaging device according to claim 4, wherein the exterior wall segment of the rotatable cork member next to the clearance gap and the inner wall segment on which the counterpart threading protrusions extend, mutually define square-circle complement region utilized for the clearance gap.

6. The packaging device according to claim 3, wherein a mechanism configuration included in the plug and allowing for the exertion of torque-free manual force for initially or repeatedly shutting the plug with its rotatable cork member comprises oblique surfaces extending each along a respective threading protrusion formed on the outwardly facing surface of the cylindrical wall member, the oblique surfaces being oriented to reduce frictional resistance resulting from dynamic-friction forces between crossing threading protrusions upon motion of counterpart threading protrusions of the rotatable cork member in a direction transversely to lengthwise orientation of respective threading protrusions formed on the cylindrical wall member under the influence of the torque-free manual force.

7. The packaging device according to claim 3, wherein a mechanism configuration included in the plug and allowing for the exertion of torque-free manual force for initially or repeatedly shutting the plug with its rotatable cork member comprises oblique surfaces extending each along a respective counterpart quarter-turn threading protrusion formed on the inner wall-surface of the rotatable cork, the oblique surfaces being oriented to reduce frictional resistance resulting from dynamic-friction forces between crossing threading protrusions upon motion of the counterpart threading protrusions of the rotatable cork member in a direction transversely to lengthwise orientation of respective threading protrusions formed on the cylindrical wall member under the influence of the torque-free manual force.

8. The packaging device according to claim 3, wherein a mechanism configuration included in the plug and allowing for the exertion of torque-free manual force for initially or repeatedly shutting the plug with its rotatable cork member comprises an inwardly oriented guide-protrusion configured to engage with and to advance through a respective linear slanting-indentation under influence of the torque-free manual force, wherein the slanting-indentation constitutes a linear channel having a longitudinal axis coplanar with a central longitudinal axis of the cylindrical wall member and having a gradually varying depth, originating with a maximum predetermined depth on an edge of the cylindrical wall member facing the second tapering end-wall the channel extends along the outer surface of the cylindrical wall member ending with a minimum depth point at a mid-portion of the outer surface of the hollow cylinder.

9. The packaging device according to claim 8, wherein the minimum depth point at the end of the channel features a seamless merger between the channel and the outer surface of the cylindrical wall member.

10. The packaging device according to claim 8, wherein the inwardly oriented guide-protrusion inwardly protrudes from a circumferential wall surface of the rotatable cork member.

11. The packaging device according to claim 8, wherein the guide-protrusion and the slanting indentation are dimensioned and positioned to maintain the guide-protrusion outside the indentations when the rotatable cork is in a partial-turn-enabled position on the plug, and in frictional engagement with outwardly facing surface of the cylindrical wall member.

12. The packaging device according to claim 1, wherein the rotatable cork member and the cylindrical wall member are mutually interlocked in the initial position by mutual protrusion and indentation arrangement requiring a predetermined torque to disengage.

13. The packaging device according to claim 1, wherein the tamper-evident band is connected by breakable perforation ribs to an edge of the rotatable cork member.

14. A packaging device for coaxially aligning and retaining a machining tool, comprising:

a plug comprising a polygonal plug part having a cylindrical wall member extending therefrom, the cylindrical wall member having an outwardly facing surface, wherein the cylindrical wall member comprises threading protrusions formed on the outwardly facing surface, wherein the plug is configured in size and shape to telescopically engage with a cap to define an inner variable space for accommodating the machining tool; and a rotatable cork member separably engageable with the cylindrical wall member of the plug, wherein the rotatable cork member comprises counterpart threading protrusions formed on an inner wall surface, the counterpart threading protrusions configured to engage with the threading protrusions on the outwardly facing surface of the cylindrical wall member, wherein the rotatable cork member comprises a tamper-evident band configured to overlappingly engage with a predetermined surface area of the polygonal plug part, wherein the tamper-evident band is configured to break apart from the rotatable cork member upon application of a predetermined angular offset between the rotatable cork member and the cylindrical wall member.

15. The packaging device of claim 14, wherein the rotatable cork member comprises inwardly oriented guide protrusions configured to engage with and advance through respective linear slanting indentations on the outwardly facing surface of the cylindrical wall member.

16. The packaging device of claim 15, wherein each of the linear slanting indentations comprises a channel having a gradually varying depth, originating with a maximum predetermined depth on an edge of the cylindrical wall member facing a tapering end wall of the rotatable cork member and ending with a minimum depth point at a mid-portion of the outwardly facing surface of the cylindrical wall member.

17. The packaging device of claim 16, wherein the threading protrusions on the cylindrical wall member and the counterpart threading protrusions on the rotatable cork member are configured with a predetermined degree of inclination to facilitate partial axial separation of the rotatable cork member from the cylindrical wall member when in an open state.

18. The packaging device of claim 14, wherein the counterpart threading protrusions extend at least partially on an inner wall segment of the rotatable cork member, the inner wall segment being configured with a predetermined degree of flexibility to allow compression, wherein the predetermined degree of flexibility of the inner wall segment allows the counterpart threading protrusions to engage with the threading protrusions on the cylindrical wall member under influence of a torque-free manual force.

19. The packaging device of claim 14, wherein the threading protrusions on the cylindrical wall member are formed with oblique surfaces oriented to reduce frictional resistance upon motion of the counterpart threading protrusions in a direction transverse to a lengthwise orientation of the threading protrusions.

20. The packaging device of claim 14, further comprising the cap, wherein the cap comprises at least one locking protrusion configured to engage with one of multiple vertically spaced slits formed on an external surface of the plug to allow the cap to lock at variable heights over the plug.

* * * * *